US010494135B2

(12) United States Patent
Pinson et al.

(10) Patent No.: US 10,494,135 B2
(45) Date of Patent: Dec. 3, 2019

(54) STORAGE CONTAINER

(71) Applicants: Sholom Pinson, Kingston, PA (US); Schneur Langsam, Kingston, PA (US)

(72) Inventors: Sholom Pinson, Kingston, PA (US); Schneur Langsam, Kingston, PA (US)

( * ) Notice: Subject to any disclaimer, the term of this patent is extended or adjusted under 35 U.S.C. 154(b) by 0 days.

(21) Appl. No.: 15/791,570

(22) Filed: Oct. 24, 2017

(65) Prior Publication Data

US 2019/0118992 A1 Apr. 25, 2019

(51) Int. Cl.

| | |
|---|---|
| ***B65D 3/04*** | (2006.01) |
| ***B65D 3/26*** | (2006.01) |
| ***B65D 85/62*** | (2006.01) |
| *A47G 7/06* | (2006.01) |
| *A47G 21/14* | (2006.01) |

(52) U.S. Cl.

CPC ..... *B65D 3/263* (2013.01); *B65D 3/04* (2013.01); *B65D 85/62* (2013.01); *A47G 7/063* (2013.01); *A47G 21/14* (2013.01)

(58) Field of Classification Search

CPC ..... B65D 5/542; B65D 5/54; B65D 5/5405; B65D 5/5445; B65D 5/5495; B65D 3/262; B65D 2543/00092; B65D 2543/00101; B65D 7/00; B65D 9/00; B65D 11/00

USPC ... 229/87.05, 901, 102, 103, 26, 927, 103.3, 229/200, 201, 210, 211

See application file for complete search history.

(56) References Cited

U.S. PATENT DOCUMENTS 2,251,283 A * 8/1941 Johnson ..... B65D 5/5445 229/101.2
2,898,025 A * 8/1959 Walker ..... B65D 5/12 229/211
3,291,372 A * 12/1966 Saidel ..... B65D 5/5445 229/101
3,561,669 A * 2/1971 Postweiler ..... B65D 5/5445 229/122.33
3,833,113 A * 9/1974 Osier ..... B65D 5/2033 206/216
3,884,348 A * 5/1975 Ross ..... B65D 5/48016 206/746
3,926,362 A * 12/1975 Beck ..... B65D 5/68 229/125.06
3,955,743 A * 5/1976 Tanneberger ..... B65D 5/061 229/117.28
3,958,747 A * 5/1976 Chipp ..... B65D 5/12 229/211
4,000,811 A * 1/1977 Hardison ..... B65D 5/48048 206/503
4,008,849 A * 2/1977 Baber ..... B65D 5/54 229/235

(Continued)

*Primary Examiner* — Brian D Nash
(74) *Attorney, Agent, or Firm* — Daniel M. Cohn; Howard M. Cohn

(57) ABSTRACT

An improved storage container is disclosed for housing items in an enclosed housing with a tamper-evident closure that is easily removed to form a storage container for the items. The storage container includes a container formed as a thin walled, hollow body closed at either end by end members and a peripheral wall defining top and bottom openings which are suitable for closure by the end members. The end member include a plurality of flaps that are integral with and extend from the hollow body and are folded over one another and then joined to each other. A perforation and tear strip encircles the peripheral wall of the hollow body.

20 Claims, 7 Drawing Sheets

(56) References Cited

U.S. PATENT DOCUMENTS 4,024,976 A * 5/1977 Acton ..... B65D 43/0212 215/50
4,113,100 A * 9/1978 Soja ..... B65D 5/5445 229/112
4,301,939 A * 11/1981 Pupp ..... B65D 43/021 220/267
4,553,666 A * 11/1985 Gullikson ..... B65D 5/5445 229/112
4,763,603 A * 8/1988 Coes ..... A01K 1/0107 119/168
4,773,541 A * 9/1988 Riddell ..... B65D 3/263 206/391
4,815,609 A * 3/1989 Kiedaisch ..... B65D 5/5405 229/235
5,052,574 A * 10/1991 McKinnon ..... B65D 43/0212 215/254
6,135,289 A * 10/2000 Miller ..... B65D 5/5088 206/470
6,142,366 A * 11/2000 Sagel ..... B65D 3/04 229/101.2
6,375,069 B1 * 4/2002 Smith ..... B65D 3/262 229/211
6,460,759 B1 * 10/2002 Lowry ..... B65D 3/04 229/101.2
7,631,776 B2 * 12/2009 Vovan ..... B65D 43/0254 220/266
8,251,242 B2 * 8/2012 Vovan ..... B65D 43/0254 220/266
8,727,204 B2 * 5/2014 Burke ..... B65D 5/2028 229/101
9,938,040 B2 * 4/2018 Buscema ..... B31B 50/60
2003/0080120 A1 * 5/2003 Whitmore ..... B65D 5/029 219/730
2006/0201946 A1 * 9/2006 Witt ..... B29C 65/10 220/276
2008/0078823 A1 * 4/2008 Pezzoli ..... B65D 5/541 229/200
2013/0306718 A1 * 11/2013 Sumpmann ..... B65B 69/0033 229/200
2014/0166507 A1 * 6/2014 Philips ..... B65D 5/5445 206/45.29
2017/0355493 A1 * 12/2017 Newlands ..... B65D 41/62

* cited by examiner

STORAGE CONTAINER

TECHNICAL FIELD OF THE INVENTION

The present invention relates to a storage container and more particularly to a storage container having a removable top secured via a tear strip.

BACKGROUND OF THE INVENTION

Many goods and products are shipped and stored in shipping containers, such as cardboard or paperboard boxes. Containers are known for storing a wide variety of items such as miscellaneous hardware, school supplies, toys and the like. Additionally containers are used for storing food, including dry food, wet food and even liquids.

Tamper-proof packaging arrangements are often provided on various consumer products such as medicines, and also on packaging for various food products. These arrangements typically include locking structures which, when tampered with, enable the consumer to easily visually recognize such tampering so that the product can then be rejected. An example of such a tamper-evident structure is a plastic locking ring connected to a cap such as those utilized on beverages. When the cap is loosened to open the container, the ring disconnects from the cap and thus provides a visual clue to the consumer in the event that the container was opened by an unauthorized person. Another type of tamper-evident feature is a plastic strip or seal which is provided externally around an opening of a container which must be removed or torn off prior to opening the container. If this strip is missing or damaged, the consumer can reject the product. In both of the above arrangements, the tamper-evident structure essentially locks the container in the closed position, and opening of the container can only be achieved by damaging or removing the locking structure.

SUMMARY OF THE INVENTION

According to an embodiment of the present invention, there is disclosed an improved storage container for housing items in an enclosed housing with a tamper-evident closure that is easily removed to form a storage container for the items. The storage container includes a container formed as a thin walled, hollow cylindrical body closed at either end by end members and a peripheral wall defining top and bottom openings which are suitable for closure by the end members. The end members include a plurality of flaps that are integral with and extend from the hollow cylinder body and are folded over one another and then joined to each other. A perforation and tear strip encircle the peripheral wall of the cylindrical body.

According to another embodiment of the present invention, there is disclosed an improved storage container for housing items in an enclosed housing with a tamper-evident closure that is easily removed to form a storage container for the items. The storage container includes a container formed as a rectangular body which includes four peripheral walls. The peripheral walls define top and bottom openings which are suitable for closure by the end members. The end members include a plurality of flaps that are integral with and extend from the hollow container and are folded over one another and then joined to each other. A perforation and tear strip encircles about the peripheral wall of the container.

According to another embodiment of the present invention, there is disclosed an improved storage container for housing items in an enclosed housing with a tamper-evident closure that is easily removed to form the storage container for the items. The storage container includes a container formed as a thin walled, hollow body closed at either end by end members. A peripheral wall defines top and bottom openings which are suitable for closure by the end members. The end members include a plurality of flaps that are integral with and extend from the hollow body and are folded over one another and then joined to each other. A perforation and tear strip encircles the peripheral wall of the hollow body. A plastic insert to hold liquids is disposed within the hollow body.

BRIEF DESCRIPTION OF THE DRAWINGS

The structure, operation, and advantages of the present invention will become further apparent upon consideration of the following description taken in conjunction with the accompanying figures (Figs.). The figures are intended to be illustrative, not limiting. Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

In the drawings accompanying the description that follows, both reference numerals and legends (labels, text descriptions) may be used to identify elements. If legends are provided, they are intended merely as an aid to the reader, and should not in any way be interpreted as limiting.

DETAILED DESCRIPTION OF THE PREFERRED EMBODIMENTS

Figure 1:
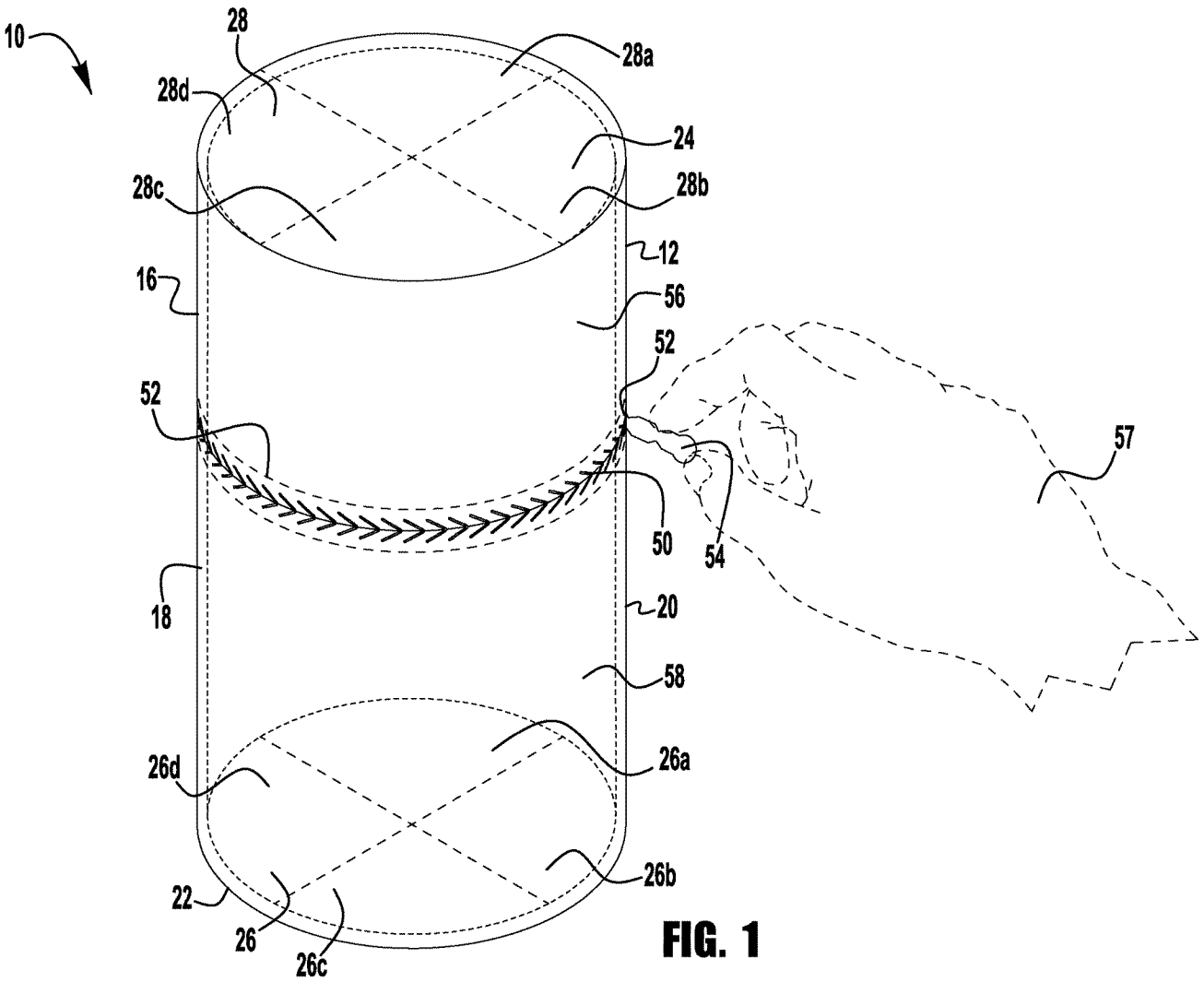
FIG. 1 is a front, three dimensional view of the improved storage container being opened, in accordance with the present invention.

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader, and should not in any way be interpreted as limiting.

Containers come in all shapes and sizes and store all different types of products. Certain containers, such as food containers, utilize a sealable cover or lid which forms a seal with the container to maintain quality and freshness of the food items stored in the container. There are several different types of covers or lids for these containers. Some containers use a snap-fit or friction-fit lid to form a seal with the container. These lids, however, are difficult to stretch and secure to the containers and are also difficult to remove because of the tight friction fit. Other lids or covers include one or more latches which engage the container to hold the lid on the container. If the latches break or stop working properly, however, a new cover and possibly a new container must be purchased, which costs consumers additional time and money.

The improved storage container 10, as shown in FIG. 1, is useful for housing any suitable items, such as cutlery 13, so that the items are not accessible without opening the container. The object of the improved storage container 10 is to house the cutlery in an enclosed housing with a tamper-evident closure, that is easily removed to form a storage container for the cutlery.

Referring to FIG. 1, there is illustrated a three-dimensional view of a first embodiment of the improved container 10 which houses the cutlery 13 so that it is not accessible without destroying the container. The container 10 is formed as a thin walled, hollow cylinder 12, including a cylindrical body 18 closed at either end by end members 26 and 28. Typically, the closed container 12 is constructed of a single sheet of material, such as a corrugated paper material, cardboard, paperboard, plastic or any other material that may creased, folded and bonded, and that is suitably rigid for storing items. Further, the container 12 may be of any suitable dimensions, such as for example a height with a range between 4 inches and 12 inches, and a circumference between 2 inches and 8 inches, when in the cylindrical shape illustrated in FIG. 1.

The container 10 is formed of a cylindrical body 18 which includes a peripheral wall 20 defining top and bottom openings 22 and 24, respectively, as seen in FIG. 1. The bottom opening and top opening 22 and 24 are suitable for closure by end members 26 and 28, respectively. The cylindrical body 18 is generally formed from one or more panels of a suitable card material cut from flat stock and curved to the required shape to form a cylindrical shape with the end members 26 and 28 formed from the one or more panels of a suitable card material so as to cover the bottom opening and the top opening, as seen in FIG. 1. The cardboard forming the container 12 may be created by laser cutting, and/or die cutting, and/or manually cutting the shape desired.

The end member 26 includes a plurality of flaps 26*a*, 26*b*, 26*c* and 26*d* that are integral with and extend from the hollow cylinder and are folded over one another and then joined to each other by means such as glue, tape, staples or cement. In the same manner, the end member 28 includes a plurality of flaps 28*a*, 28*b*, 28*c* and 28*d* that are integral with and extend from the hollow cylinder and are folded over one another and then joined to each other by means such as glue, tape, staples or cement.

Prior to closing the bottom opening 22 and the top opening 24, the items, such as cutlery 13, are inserted into the cylindrical body 18 through either opening 22 or 24. Then the end members 26 and 28 are closed so that the items 13 are not accessible. The house the cutlery in an enclosed housing with a tamper-evident closure, that is easily removed to form a storage container for the cutlery. The result is a cylindrical body closed at both ends that can be only be opened to remove the items by breaking into the container 12 in a way that would give evidence to the fact that the container had been tampered with.

Figure 2:
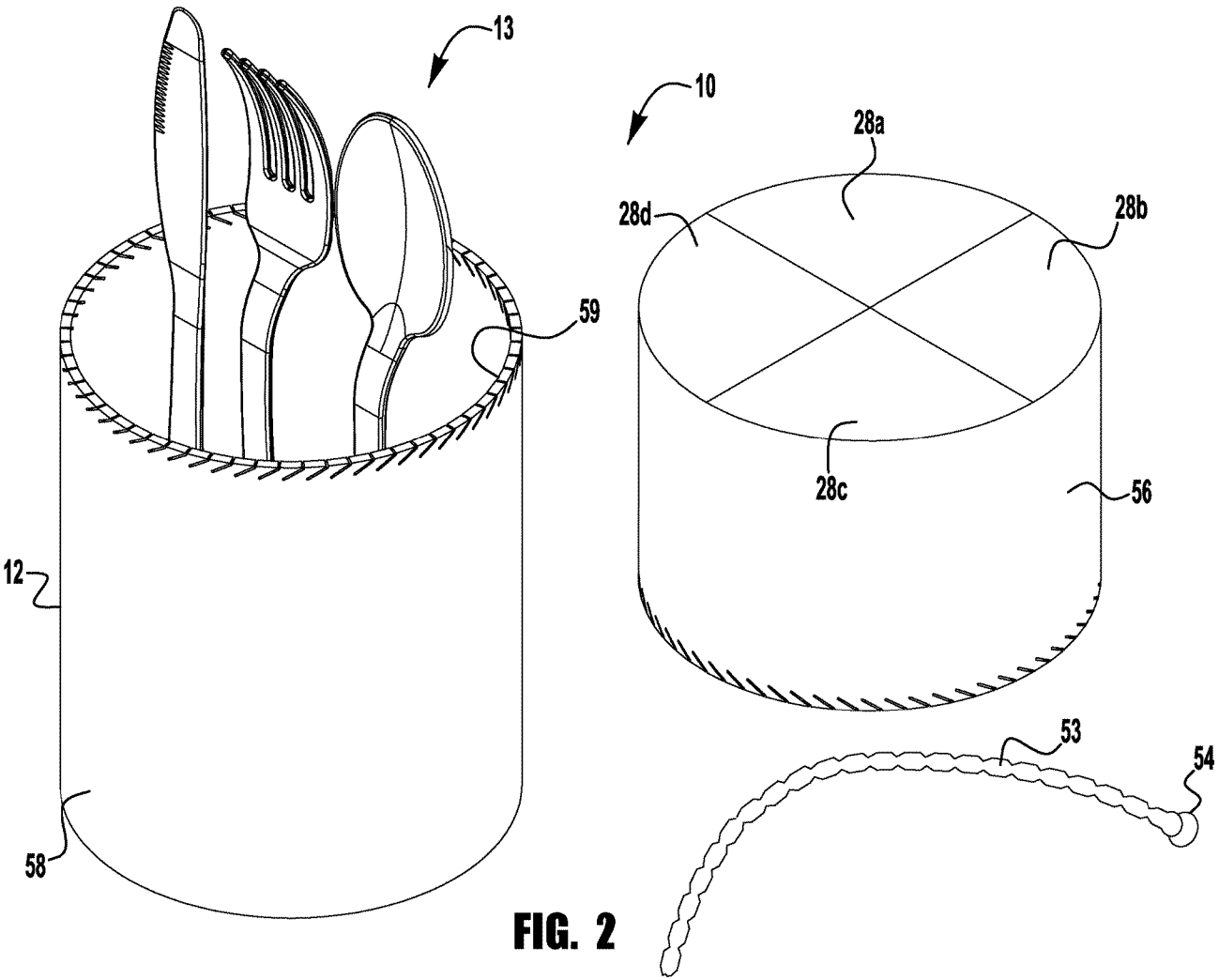
FIG. 2 is a front, three dimensional view of the improved storage container in use, in accordance with the present invention.

As illustrated in FIGS. 1 and 2, there is a perforation 50 and tear strip 52 encircling the peripheral wall 20 of the cylindrical body 18, preferably between one half ½) and two thirds (⅔) of the height measured from the bottom opening 22 of the cylindrical body to the top opening 24. The tear strip 52 provides easy tearing along perforation 50. The tear strip 52 is designed to tear open consistently perforation 50, with a relatively uniform tearing force, without excessive distortion of the perforation 50. The tear strip 52 can include a pull tab 54, as seen in FIG. 2.

As illustrated in FIG. 1, the perforation 50 is formed between top and bottom portions 56 and 58 of the cylindrical body 18. Typically, the tear strip 52 is formed of a continuous length of material, such as plastic ribbon, string, cardboard or wire or any other type of material that is strong enough to cut through the wall of the container but malleable enough to be adhered to the inside wall or interior surface 59 of the container. The tear strip 52 is generally secured to the interior surface 59, as seen in FIG. 2, of the cylindrical body 18 directly below or above the perforation 50 with an end of the tear strip sticking out of the cylinder. For example, to tear through the perforation 50, the pull tab 54 is gripped by a user 57, as shown in FIG. 1, and pulled around the circumference of the container thereby pulling the tear strip material 52 such that it separates the perforation 50. Although a pull tab 54 is shown, any desired means of pulling the material 52 to tear the perforation 50 may be utilized, such as a loop attached to the tear strip material (not shown).

As shown in FIG. 2, when the tear strip 52 is pulled around the cylindrical body 8, and the perforation 50 is separated, the top and bottom portions 56 and 58 of the cylindrical body 18 can be separated from each other. The top portion 56 is typically discarded following their separation from the bottom portion 58. However, it is within the terms of the embodiment that the top portion 56 be reattached to the bottom portion 58.

In use, the cutlery 13 housed within the canister 12 is not accessible without opening the container. Until the tear strip 52 is torn, and the perforation 50 is separated, the top and bottom portions 56 and 58 are sealed within the canister 12, such that no one may tamper with the cutlery 13 therein until the canister 12 reaches the final consumer. When the user desires, he may tear the tear strip 52 and discard the top portion 56 so that the cutlery is stored in the bottom portion 58.

Figure 3:
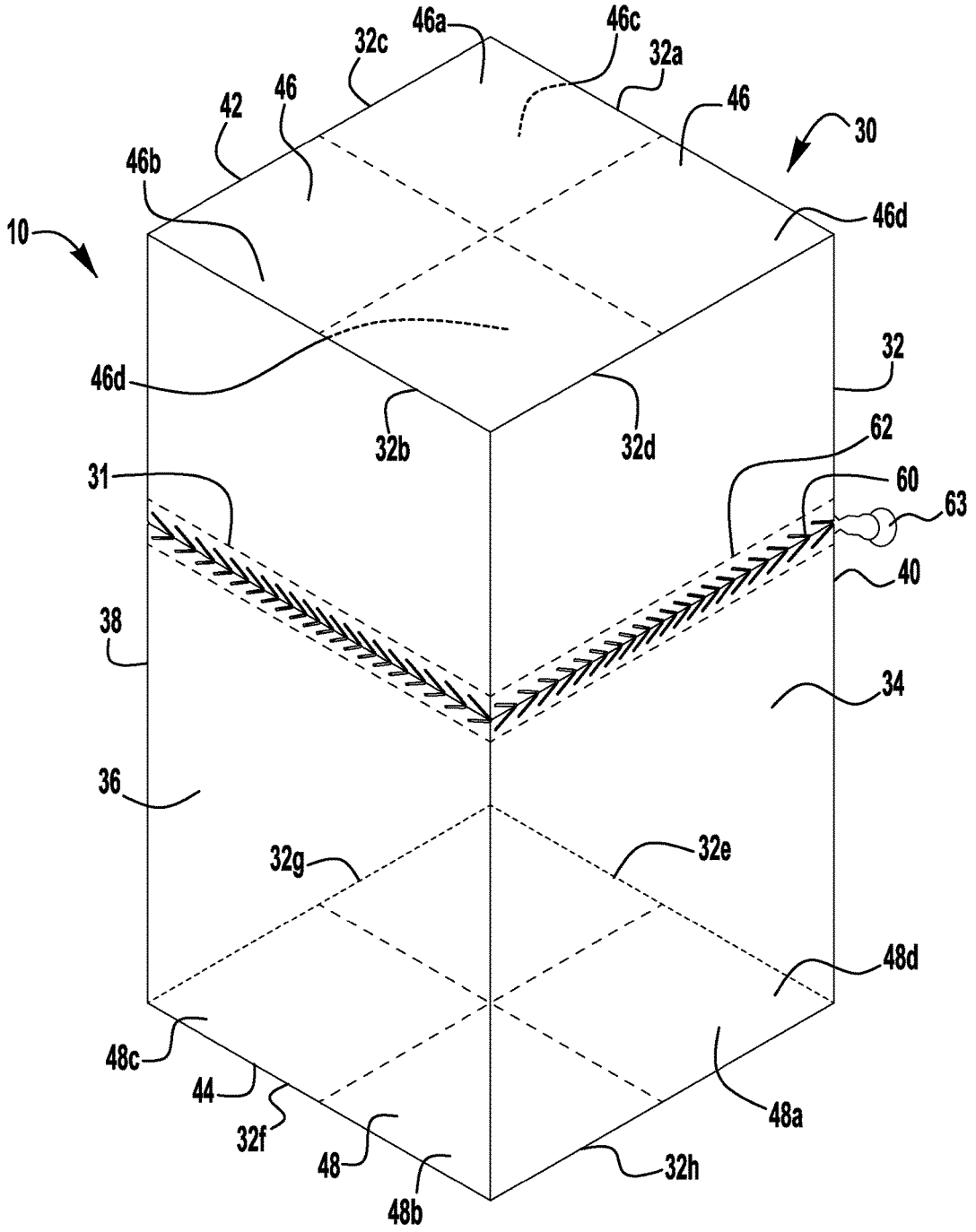
FIG. 3 is a front, three dimensional view of a rectangular shaped improved storage container, in accordance with the present invention.
Figure 4:
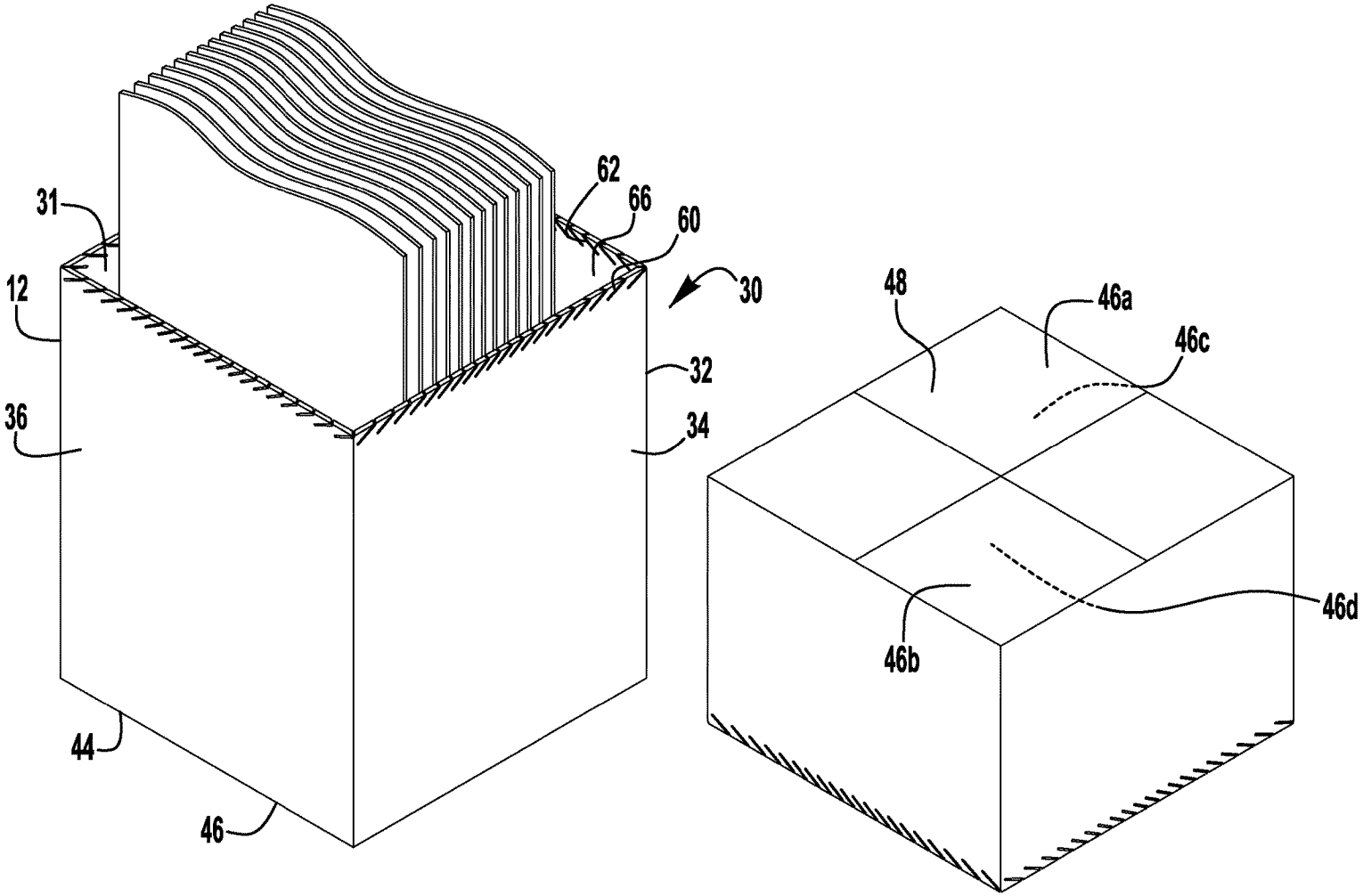
FIG. 4 is a front, three dimensional view of a rectangular shaped improved storage container after being opened, in accordance with the present invention.

It should be noted that the container 10 may be constructed of any desired shape, such as the rectangular shaped container 30 as seen in FIGS. 3 and 4. The rectangular shaped container 10 is formed of a rectangular body 32 which includes a peripheral walls 34, 36, 38, and 40, and defining top and bottom openings 42 and 44, respectively, as seen in FIG. 3. The top opening and bottom opening 42 and 44 are suitable for closure by end members 46 and 48, respectively. The rectangular shaped container 30 is generally formed from one or more panels of a suitable card material cut from flat stock and formed to the required shape to form a rectangular shape with the end members 46 and 48 formed from the one or more panels of a suitable card material so as to cover the bottom opening and the top opening, as seen in FIG. 1. The cardboard forming the container 30 may be created by laser cutting, and/or die cutting, and/or manually cutting the shape desired. The container 30 can be used to store any desired items, such as napkins as illustrated. The items are inserted into the rectangular shaped container 30 through the top and bottom openings 42 and 44, and then the end members 46 and 48 are closed so that the items are not accessible.

The end member 46 includes a plurality of flaps 46*a*, 46*b*, 46*c* and 46*d* that are integral with and extend from the rectangular body 32 and are folded over one another and then joined to each other by means such as glue, tape, staples or cement. In the same manner, the end member 48 includes a plurality of flaps 48*a*, 48*b*, 48*c* and 48*d* that are integral with and extend from the hollow cylinder and are folded over one another and then joined to each other by means such as glue, tape, staples or cement.

As illustrated in FIGS. 4, there is a perforation 60 and tear strip 62 about the peripheral wall 31 of the container 30, preferably between one half ½) and two thirds (⅔) of the height measured from the bottom opening 44 to the top opening 42. The tear strip 62 provides easy tearing along perforation 60. The tear strip 62 is designed to tear open consistently perforation 60, with a relatively uniform tearing force and without excessive distortion of the perforation 60.

Typically, the tear strip 62 is formed of a continuous length of material, such as plastic ribbon, string, cardboard, wire or any other type of material that is strong enough to cut through the wall of the container but malleable enough to be adhered to the inside wall or interior surface 60 of the container. The tear strip 62 is generally secured to an interior surface 66, as seen in FIGS. 3 and 4, of the rectangular container 30 directly below or above the perforation 60 with an end of the tear strip sticking out of the container. The tear strip 52 can include a pull tab 63, as seen in FIG. 3. Functionally, the container 30, including the tear strip 62, works identical to the description above of the cylindrical container 12.

Figure 5:
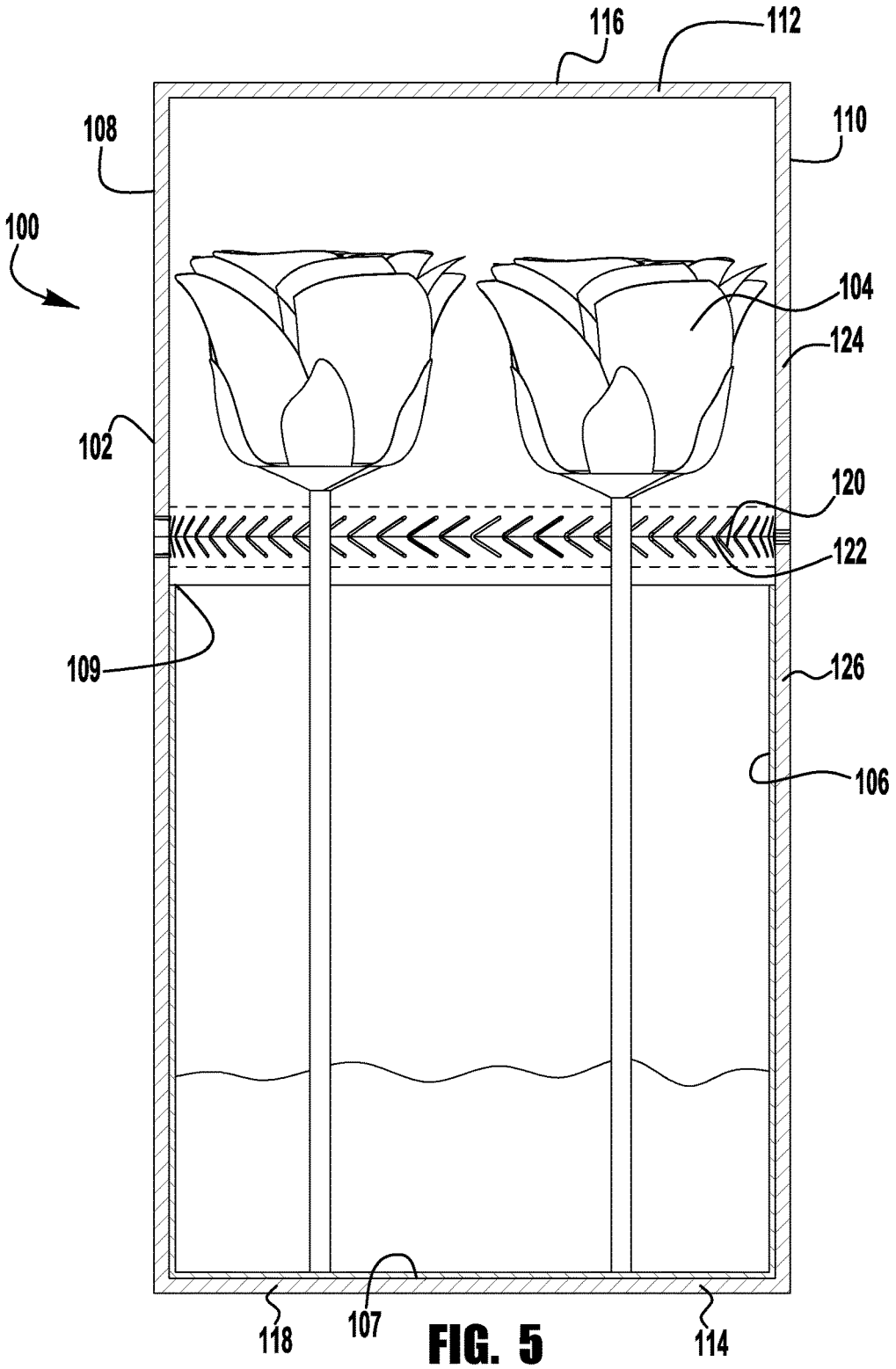
FIG. 5 is a front, cross sectional view of an alternative embodiment of the storage container being opened, in accordance with the present invention.

FIG. 5 illustrates an alternative embodiment of the improved storage container 100, As before, although a cylindrical shape container 102 is illustrated, the alternative embodiment of the improved storage container 100 can be used with any desired shape, such as a rectangular shaped container.

The improved storage container 100 relates to a rigid container 102 suitable for storing any suitable items, preferably flowers 104, designed with a removable closure. The improved storage container 100 is distinguished from the first embodiment of the improved storage container 10 in that it contains a plastic insert 106 to hold water or other liquids therein. FIG. 5 illustrates a front, cross-sectional view of the improved storage container 100. The object of the improved storage container 100 is to provide a storage container with a tamper-evident closure that is easily removed and a plastic insert 106 to hold water or other liquids therein.

Typically, the container 102 is constructed of a single sheet of material, such as a corrugated paper material, cardboard, paperboard, plastic or any other material that may creased, folded and bonded, that is suitably rigid for storing items. Further, the container 102 may be of any suitable dimensions, such as for example a height with a range between _____ inches and _____ inches, and a circumference between _____ inches and _____ inches, when in the cylindrical shape illustrated in FIG. 1.

The container 102 is formed of a cylindrical body 108 which includes a peripheral wall 110 defining top and bottom openings 112 and 114, respectively, as seen in FIG. 1. The top opening and bottom opening 112 and 114 are suitable for closure by end members 116 and 118, respectively. The cylindrical body 108 is generally formed from one or more panels of a suitable card material cut from flat stock and curved to the required shape to form a cylindrical shape with the end members 1.16 and 118 formed from the one or more panels of a suitable card material so as to cover the bottom opening 114 and the top opening 112, as seen in FIG. 5. The cardboard forming the container 102 may be created by laser cutting, and/or die cutting, and/or manually cutting the shape desired.

There is a perforation 120 disposed along the peripheral wall 110 of the cylindrical body 108, preferably approximately 2/3 up the body. The perforation 120 forms a tear strip 122 to provide easy tearing in a direction generally transverse to the tear strip. The tear strip 122 is designed to tear open consistently, with a relatively uniform tearing force, without excessive distortion of the perforation 120. The tear strip 122 operates identically to the operation of the first embodiment of the improved storage container 10.

The perforation 120 is formed between top and bottom portions 124 and 126 of the cylindrical body 108. As described above, when the tear strip 122 is torn, and the perforation 120 is separated, the top and bottom portions 124 and 126 of the cylindrical body 108 are separated. The top portion 124 is typically discarded following their separation from the bottom portion 126. However, it is within the terms of the embodiment that the top portion 124 can be reattached to the bottom portion 126.

A plastic insert 106 is designed to hold liquids therein and is disposed within the bottom portion 126 of the cylindrical body 108. The plastic insert 106 has a closed end 107 and an open end 109. The closed end 107 of the plastic insert 106 typically rests against the end member 118 of the bottom opening 114. The open end 109 of the plastic insert 106 is disposed directly below the perforation 120, such that when the top portion 124 is separated from the bottom portion 126, the open end of the insert can be filled with a liquid if desired and the liquid will not permeate the bottom portion and/or the end member 118 to distort or otherwise ruin the integrity of the cylindrical body 108. It is also within the terms of invention for the open end of the plastic insert 106 to be disposed directly above the perforation 120, such that when the top portion 124 is separated from the bottom portion 126, the open end of the insert projects out of the bottom portion 126. Here again, the insert can be filled with a liquid if desired and the liquid will not permeate the bottom portion 126 and/or the end member 118 to distort or otherwise ruin the integrity of the cylindrical body 108.

Figure 6:
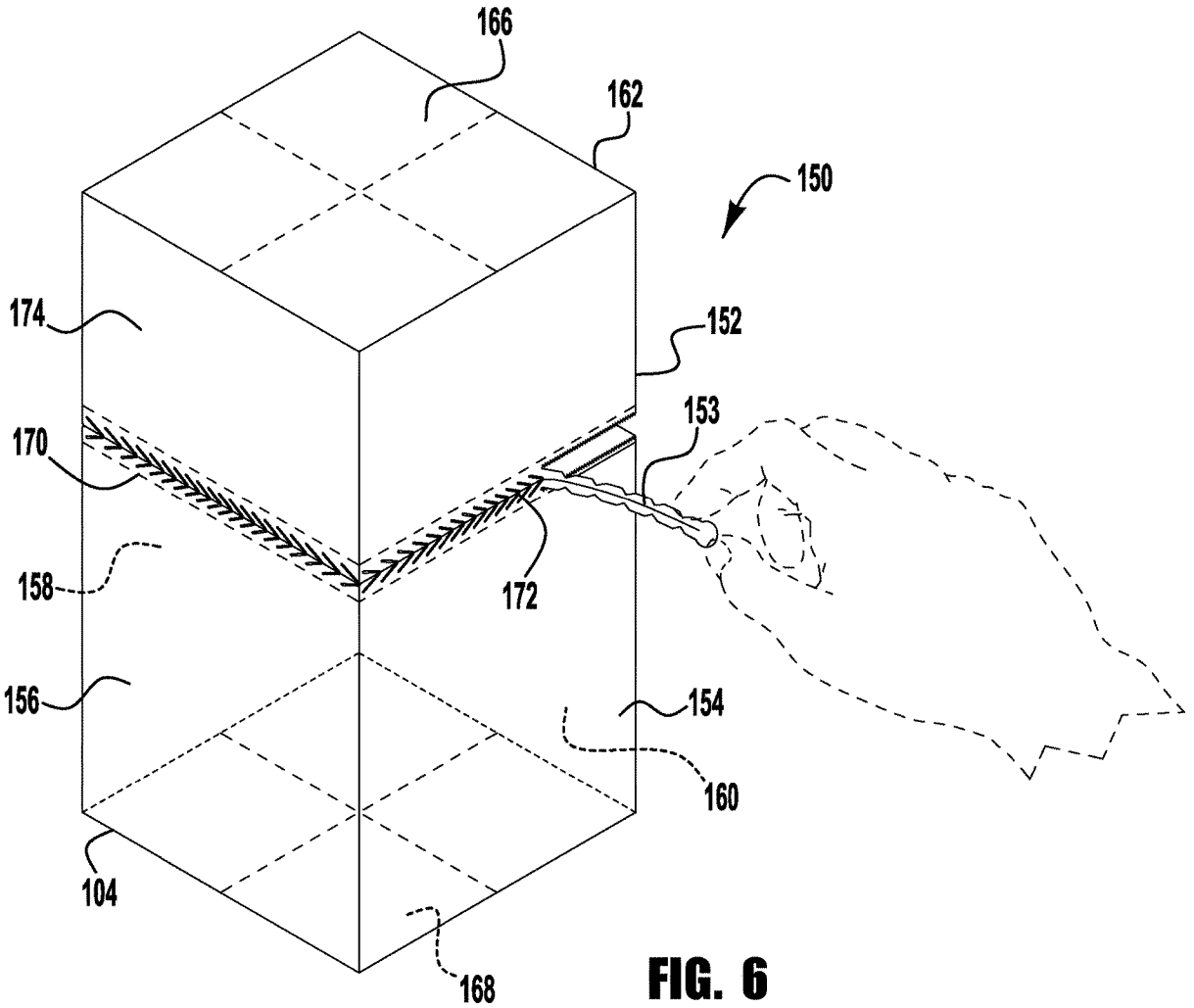
FIG. 6 is a front, three dimensional view of an alternative embodiment of a rectangular shaped improved storage container being opened by a pulling a tear strip, in accordance with the present invention.
Figure 7:
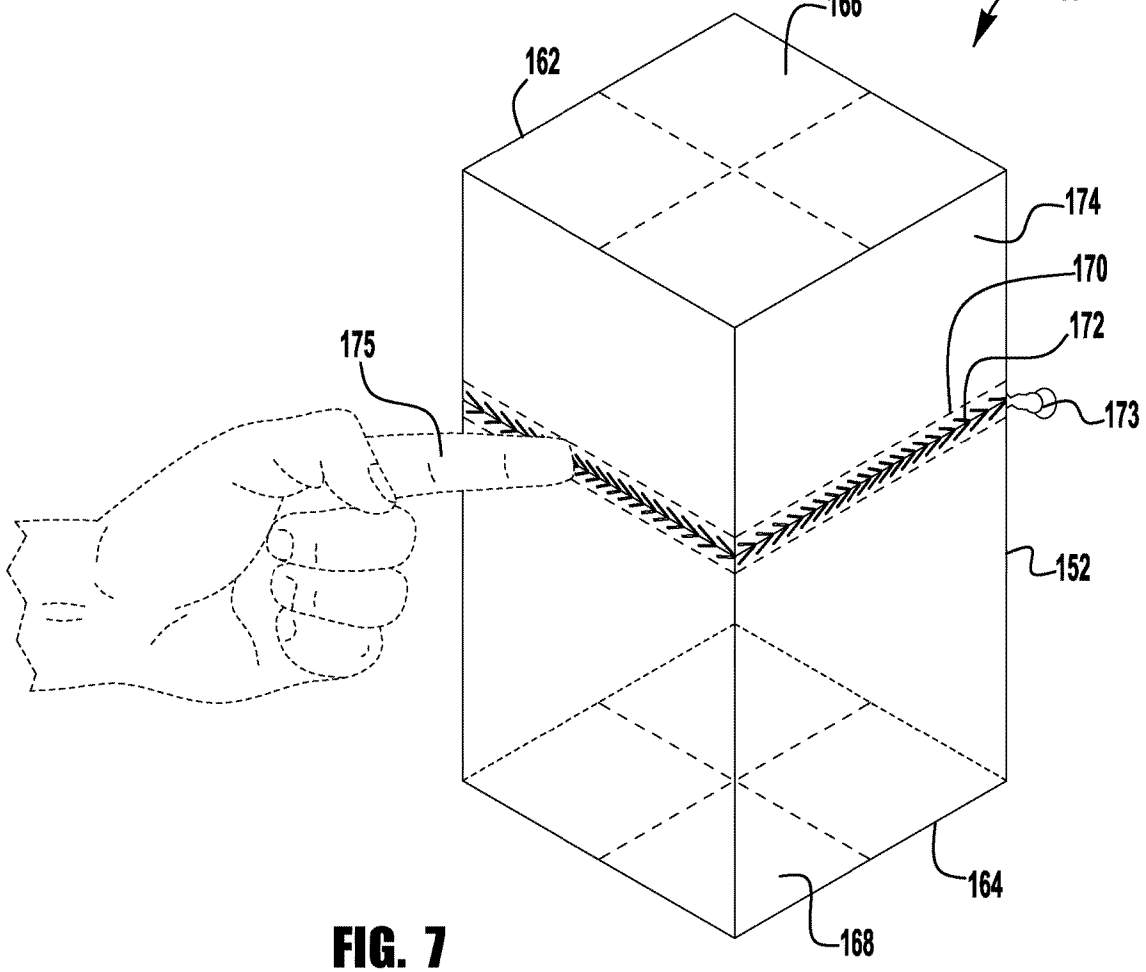
FIG. 7 is a front, three dimensional view of an alternative embodiment of a rectangular shaped improved storage container being opened by a pressing into the tear strip, in accordance with the present invention.

In an alternative embodiment as seen in FIGS. 6 and 7, the container 150 may be constructed of any desired shape, such as the illustrated rectangular shaped container.

In the same manner as described with respect to FIG. 3, the end member 166 includes a plurality of flaps that are integral with and extend from the rectangular body 152 and are folded over one another and then joined to each other by means such as glue, tape, staples or cement. In the same manner, the end member 168 includes a plurality of flaps that are integral with and extend from the hollow cylinder and are folded over one another and then joined to each other by means such as glue, tape, staples or cement.

As illustrated in FIGS. 6 and 7, there is a perforation 170 and tear strip 172 about the peripheral wall 174 of the container 150, preferably between one half ½) and two thirds (⅔) of the height measured from the bottom opening 164 to the top opening 162.

The tear strip 172 provides easy tearing along perforation 170. The tear strip 62 is designed to tear open consistently perforation 170, with a relatively uniform tearing force, without excessive distortion of the perforation 170.

Typically, the tear strip 172 is formed of a continuous length of material, such as the same material, such as cardboard of the rectangular container 150, disposed directly below or above the perforation 170 with an end 173 of the tear strip sticking out from the container. Functionally, the container 150, as shown in FIG. 6, works identically to the description above of the cylindrical container 12. That is, the end 173 of the tear strip can be pulled away from the container 150 so that when the perforation 170 is separated, the top and bottom portions 152 and 154 of the rectangular body 152 are separated from each other.

Referring to FIG. 7, the tear strip 172 is formed of a continuous length of material, such as the same material, such as cardboard, of the rectangular container 150. The tear strip 172 is disposed directly below or above the perforation 170 with an end 173 of the tear strip sticking out from the container. Functionally, the container 150, as shown in FIG. 7, works identically to the description above of the container shown in FIG. 6 except that instead of pulling the end 173 of the tear strip 172 away from the container 150 so that the perforation 170 is separated, the tear strip can be pressed or pushed open with an object such as a person's finger 175 as shown. Then the tear strip can be removed and the top and bottom portions 152 and 154 of the rectangular body 152 separated from each other.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. An improved storage container for housing non-food items, comprising;

an enclosed housing with a tamper-evident closure that is easily removed to form top and bottom portions, whereby the non-food items are stored within the bottom portion when separated;

the storage container formed as a thin, single wall, hollow cylindrical body defining top and bottom openings closed at either end by end members whereby the items enclosed within the storage container are not accesible without opening the container;

each of the end members including a plurality of flaps that are integral and extend from the hollow cylinder and are folded over one another and then joined to each other; and the tamper-evident closure being a perforation and tear strip encircling the single wall of the cylindrical body separating the top and bottom portions, such that when the perforation and tear strip is removed from the cylindrical body, the top and bottom portions can be separated from each other and the top portion can be reattached to the bottom portion.

2. The improved storage container of claim 1 wherein the cylindrical body is constructed of a single sheet of material from a group consisting of corrugated paper material, cardboard, paperboard and plastic that may be creased, folded and bonded.

3. The improved storage container of claim 2 wherein the cylindrical body is formed from one or more panels of a suitable card material cut from flat stock and curved to a required shape to form a cylindrical shape with the end members formed from the one or more panels so as to cover the top and bottom openings.

4. The improved storage container of claim 1 wherein the items are inserted into the cylindrical body through the top and bottom openings, and then closing the end members so that the items are not accessible.

5. The improved storage container of claim 1 wherein the perforation and tear strip encircling the peripheral wall of the cylindrical body are between one half (½) and two thirds (⅔) of a height measured from the bottom opening of the cylindrical body to the top opening.

6. The improved storage container of claim 5 wherein the tear strip includes a pull tab.

7. The improved storage container of claim 5 wherein the perforation is formed between top and bottom portions of the cylindrical body.

8. The improved storage container of claim 7 wherein the tear strip is secured to an interior surface of the cylindrical body directly below or above the perforation with an end of the tear strip sticking out of the cylindrical body.

9. An improved storage container for housing non-food items, comprising;

an enclosed housing with a tamper-evident closure that is easily removed to form top and bottom portions, whereby the non-food items are stored within the bottom portion when separated;

the container formed as a thin, single wall, hollow rectangular body which includes four peripheral walls defining top and bottom openings closed at either end by end members whereby the items enclosed within the storage container are not accesible without opening the container;

each of the end members including a plurality of flaps that are integral with and extend from the container and are folded over one another and then joined to each other; and the tamper-evident closure being a perforation and tear strip encircling the single walls of the rectangular body separating the top and bottom portions, such that when the perforation and tear strip is removed from the rectangular body, the top and bottom portions can be separated from each other and the top portion can be reattached to the bottom portion.

10. The improved storage container of claim 9 wherein the items are inserted into the rectangular body through the top and bottom openings, and then closing the end members so that the items are not accessible.

11. The improved storage container of claim 10 wherein the perforation and the tear strip are formed about the peripheral wall between one half (½) and two thirds (⅔) of the height measured from the bottom opening to the top opening.

12. The improved storage container of claim 11 wherein the tear strip is secured to an interior surface of the rectangular container directly below or above the perforation with an end of the tear strip sticking out of the container.

13. The improved storage container of claim 9 wherein the tear strip includes a pull tab.

14. An improved storage container for housing non-food items, comprising;

an enclosed housing with a tamper-evident closure that is easily removed to form top and bottom portions, whereby the non-food items are stored within the bottom portion when separated;

the storage container formed as a thin, single wall, hollow cylindrical body defining top and bottom openings closed at either end by end members whereby the items enclosed within the storage container are not accesible without opening the container;

each of the end members including a plurality of flaps that are integral with and extend from the hollow cylinder and are folded over one another and then joined to each other;

the tamper-evident closure being a perforation and tear strip encircling the single wall of the cylindrical body separating the top and bottom portions, such that when the perforation and tear strip is removed from the cylindrical body, the top and bottom portions can be separated from each other and the top portion can be reattached to the bottom portion; and a cylindrically shaped plastic insert closed at one end disposed within and resting against the end member of the bottom opening of the bottom portion of the storage container to be filled with a liquid after the perforation and tear strip is removed from the cylindrical body and the top and bottom portions are separated.

15. The improved storage container of claim 14 wherein the cylindrically shaped plastic insert is closed at one end and disposed within the container so that the closed end is disposed against the end member forming the bottom opening.

16. The improved storage container of claim 15 wherein the perforation encircles the peripheral wall of the cylindrical body at a location is formed between top and bottom portions of the cylindrical body.

17. The improved storage container of claim 15 wherein the cylindrically shaped plastic insert is open at one end and disposed within the container so that the open end is disposed adjacent the perforation such that when the top portion is separated from the bottom portion, the open end of the insert can be filled with a liquid.

18. The improved storage container of claim 17 wherein he cylindrically shaped plastic insert is open at one end and disposed within the container so that the open end is disposed below the perforation such that when the top portion is separated from the bottom portion, the open end of the insert can be filled with a liquid.

19. The improved storage container of claim 17 wherein the cylindrically shaped plastic insert is open at one end and disposed within the container so that the open end is disposed directly above the perforation such that when the top portion is separated from the bottom portion, the open end of the insert can be filled with a liquid.

20. The improved storage container of claim 17 wherein the perforation and tear strip encircling the peripheral wall of the cylindrical body are between one half (½) and two thirds (⅔) of a height measured from the bottom opening to the top opening of the cylindrical body.

* * * * *